US009862466B2

(12) United States Patent
Hall

(10) Patent No.: US 9,862,466 B2
(45) Date of Patent: Jan. 9, 2018

(54) INFLATABLE PADDLE BOARD

(71) Applicant: Twitch, LLC, Steamboat Springs, CO (US)

(72) Inventor: Peter Hall, Steamboat Springs, CO (US)

( * ) Notice: Subject to any disclaimer, the term of this patent is extended or adjusted under 35 U.S.C. 154(b) by 0 days.

(21) Appl. No.: 15/230,435

(22) Filed: Aug. 7, 2016

(65) Prior Publication Data

US 2017/0036742 A1 Feb. 9, 2017

Related U.S. Application Data

(60) Provisional application No. 62/202,549, filed on Aug. 7, 2015.

(51) Int. Cl.
*B63B 35/79* (2006.01)

(52) U.S. Cl.
CPC ..... *B63B 35/7913* (2013.01); *B63B 35/7916* (2013.01)

(58) Field of Classification Search
CPC ..... B63B 35/73; B63B 35/79; B63B 35/7913; B63B 35/7916; B63B 7/00; B63B 7/08; B63B 7/085
USPC ..... 441/65, 66, 74
See application file for complete search history.

(56) References Cited

U.S. PATENT DOCUMENTS

| | | | | |
|---|---|---|---|---|
| 6,394,018 | B1 * | 5/2002 | Klimenko | B63B 7/085 441/66 |
| 7,861,662 | B2 | 1/2011 | Rista | |
| 9,114,862 | B2 * | 8/2015 | Dingel | B63B 35/7913 |
| 2013/0137319 | A1 * | 5/2013 | Haller | B63B 35/7913 441/66 |
| 2014/0080369 | A1 * | 3/2014 | Haller | B63B 35/79 441/66 |

OTHER PUBLICATIONS

Internet page from http://www.boatownersworld.com/sea-eagle-473rl-razorlite-kayak.html. NPL image captured by web.achive.org 5 times between Mar. 16, 2016 and May 18, 2016; however Applicant is aware of products for sale on this page at least as early as Aug. 4, 2015.

* cited by examiner

*Primary Examiner* — Lars A Olson
(74) *Attorney, Agent, or Firm* — Trenner Law Firm, LLC; Mark D. Trenner

(57) ABSTRACT

An example inflatable paddle board includes a first inflatable chamber forming a stand-up board, and a second inflatable chamber connected to the first inflatable chamber to form a curve-shaped front hull. In an example, the second inflatable chamber at least partially overhangs the first inflatable chamber. In another example, the first inflatable chamber at least partially overhangs the second inflatable chamber. A tent may cover between the first inflatable chamber and the second inflatable chamber.

20 Claims, 8 Drawing Sheets

INFLATABLE PADDLE BOARD

PRIORITY CLAIM

This application claims the priority benefit of U.S. Provisional Patent Application No. 62/202,549 filed on Aug. 7, 2015 titled "Inflatable Paddle Board" of Peter Hall, hereby incorporated by reference for all that it discloses as though fully set forth herein.

BACKGROUND

Stand-up paddle boarding is believed to have originated in Hawaii by surfers standing on long surf boards and using paddles. Unlike surfing, however, paddle boarding can be easier to learn for a wider spectrum of people. Even some surfers enjoy paddle boarding because of its versatility. For example, paddle boarding can be practiced in still waters without surf, and is increasingly being practiced on rivers in whitewater and other bodies of water.

DETAILED DESCRIPTION

An inflatable paddle board is disclosed. In an example, the inflatable paddle board may have two chambers on top of each other to create extra buoyancy and a larger rocker in the nose of the board. The two chambers may be made separately and combined (e.g., glued or otherwise adhered together). The top chamber may overhang the lower chamber by about 8 inches. However, other examples, including no overhang are also possible (e.g., depending on the desired shape of the board). For example, the design may include under- and/or overhanging inflatable chambers (e.g., the top chamber overhangs and/or under-hangs the bottom chamber). The two chambers may be connected with a tent (e.g. PVC or other suitable fabric), or be manufactured as drop stitch chambers.

In an example, an inflatable paddle board includes a lower inflatable chamber forming a stand-up board, and an upper inflatable chamber connected to the lower inflatable chamber, the upper inflatable chamber forming a rail around at least a portion of the lower inflatable chamber, and the combination of the lower and upper inflatable chambers forming a curve-shaped front hull. The rail is formed around a front and front-side portion of the lower inflatable chamber. The inflatable paddle board may also include a tent covering between the first inflatable chamber and the second inflatable chamber. In an example, the tent forms a separate inflatable air chamber.

An example method of constructing an inflatable paddle board includes forming a stand-up board area from a lower inflatable chamber. The method also includes connecting an upper inflatable chamber to the lower inflatable chamber to form a rail around at least a portion of the lower inflatable chamber. The method also includes providing a tent covering between the first inflatable chamber and the second inflatable chamber to form a curve-shaped front hull.

The example inflatable paddle board enables a flat stand-up board with a shaped front or bow (e.g., a curve shaped hull). The example inflatable paddle board provides a uniform, smooth, and responsive shape by connecting inflatable chambers. The example inflatable paddle board also enables a conforming bow shape that provides the inflatable paddle board with a rocker shape that enables the bow to "punch" through whitewater more quickly, while still maintaining the nose of the inflatable paddle board above the water and surf.

Before continuing, it is noted that as used herein, the terms "includes" and "including" mean, but is not limited to, "includes" or "including" and "includes at least" or "including at least." The term "based on" means "based on" and "based at least in part on."

Figure 1:
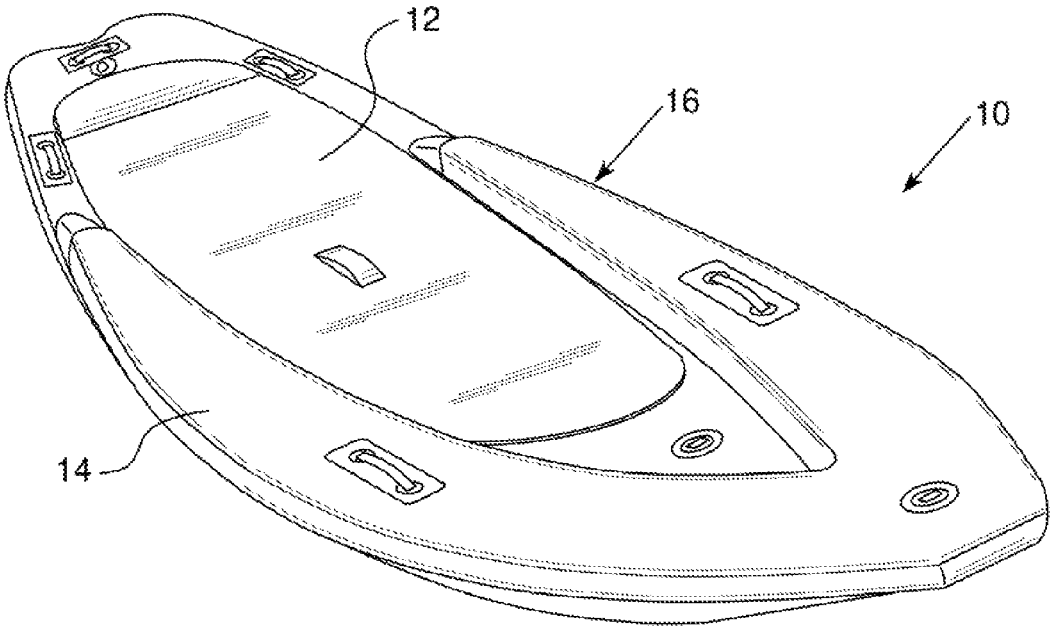
FIG. 1 is a top perspective view of an example inflatable paddle board.
Figure 2A:
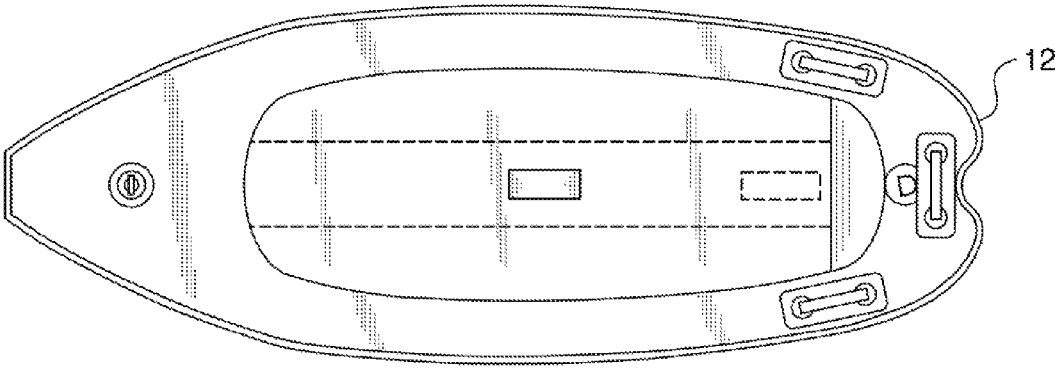
FIGS. 2A-2F are top and side views illustrating components and assembly of an example inflatable paddle board.
Figure 2B:
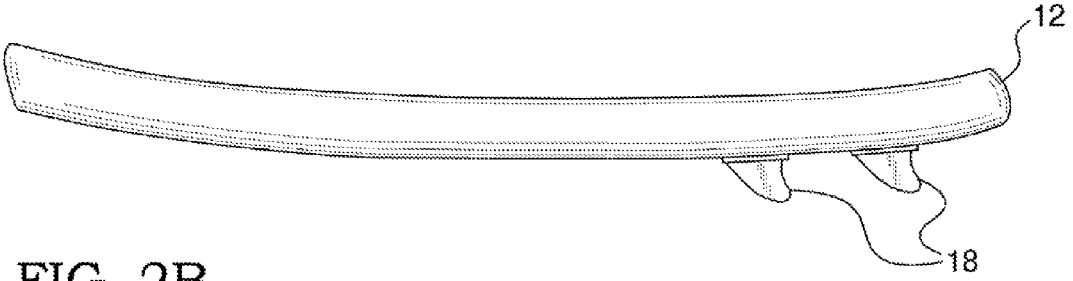
Figure 2C:
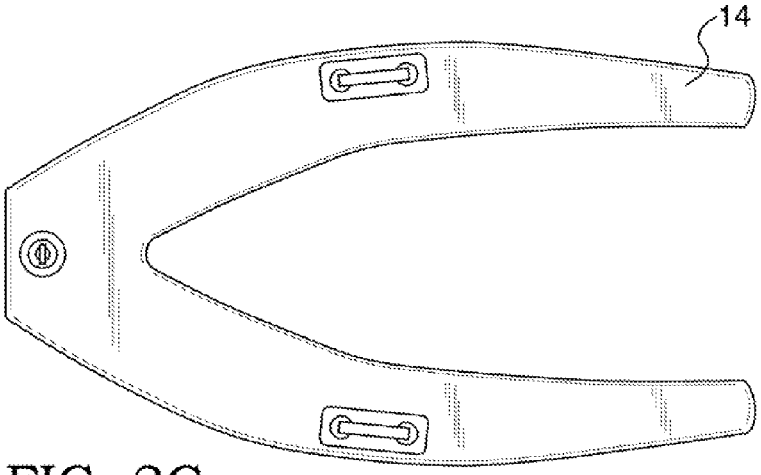
Figure 2D:
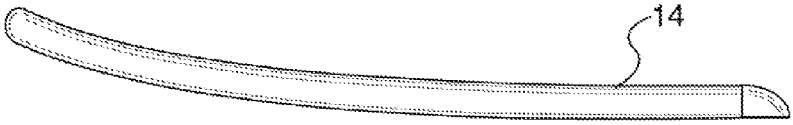
Figure 2E:
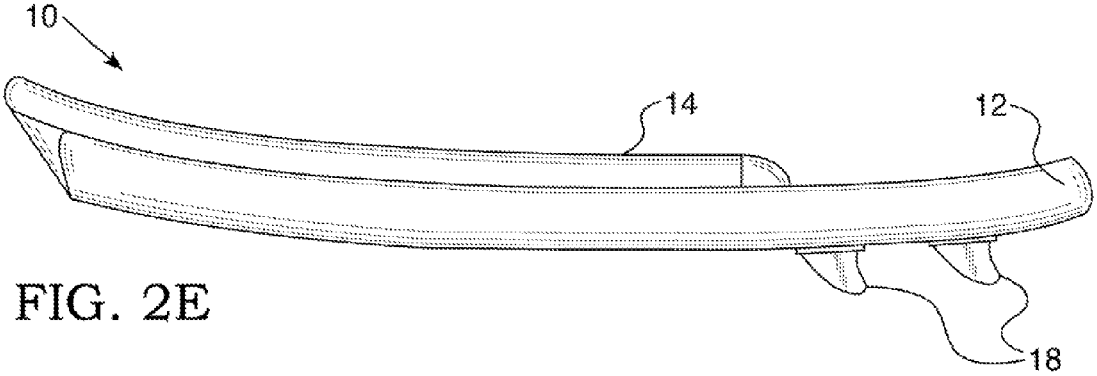
Figure 2F:
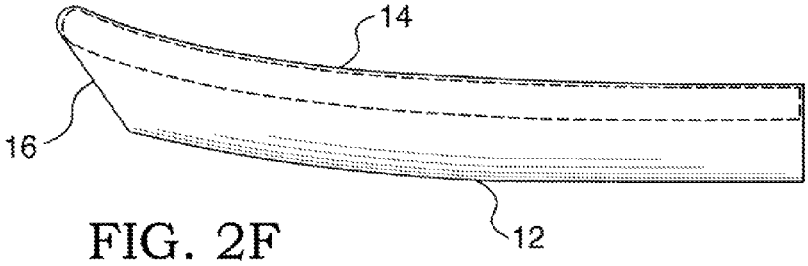
Figure 3A:
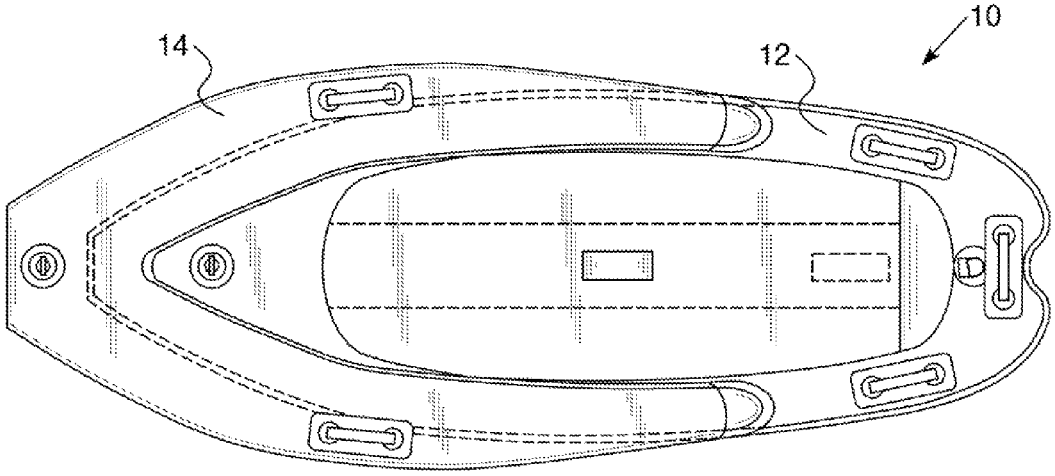
FIGS. 3A-3C are top, side, and bottom views, respectively, of the example inflatable paddle board of FIGS. 2A-F shown assembled.
Figure 3B:
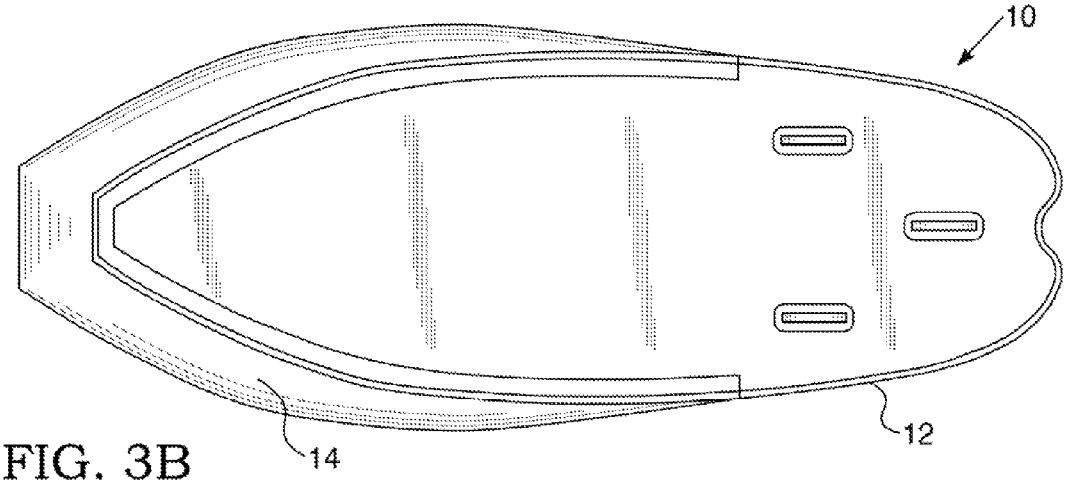
Figure 3C:
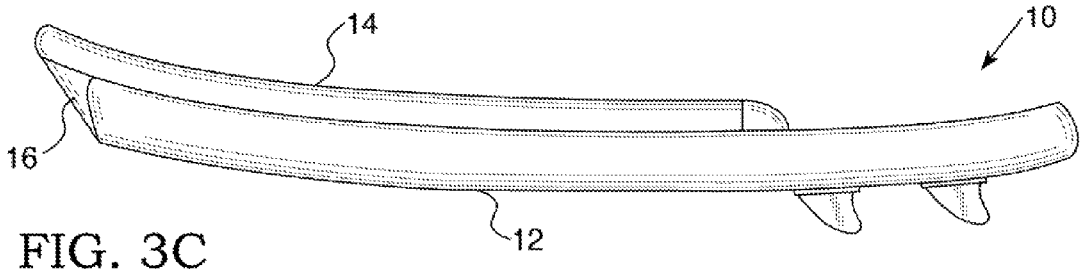

FIG. 1 is a top perspective view of an example inflatable paddle board 10. The example inflatable paddle board 10 may have at least one inflatable chamber. In an example, the inflatable paddle board includes two inflatable chambers (e.g., a first chamber and a second chamber). It is noted that the terms "first" and "second" are used herein to distinguish between separately formed chambers, but do not imply ordering or position (unless specifically referred to herein as an "upper" or "lower" chamber). More chambers may also be provided. In an example, the inflatable paddle board 10 includes a board chamber 12 to form a stand-up board area, and a rail chamber 14 to form a rail at least partially around the stand-up board area. The stand-up board area and/or rail may be formed of multiple chambers.

One or more chamber may be a drop stitch chamber. The term "drop stitch" is used herein to describe a manufacturing technique, wherein two sheets of fabric (e.g., polyester woven support fabric or other suitable material) is joined by many (e.g., thousands) of threads of predetermined length (s). The sewing needles sew a continuous thread back and forth between the two pieces of fabric, locking the fabric together at predetermined spacing(s) (e.g., the spacing based on the length of the threads between the fabrics). A side material can be applied, or the edges of the top and bottom fabrics can be attached. Following the sewing, an air-tight coating is applied to the outer surfaces of the fabric to provide an air-tight chamber that can be inflated. The process enables manufacture of a chamber that can be inflated to form a desired shape (e.g., a flat surfaced board structure). Other manufacturing techniques are also contemplated as will be readily understood by those having ordinary skill in the art after becoming familiar with the teachings herein.

In an example, the lower chamber 12 is the shape and outline of a stand-up board. Hence, it may be referred to as the board chamber 12. The upper chamber 14 is generally U-shaped, and may have a flat or substantially flattened nose. The upper chamber 14 may be referred to as the rail chamber 14. The rail chamber 14 may be connected to the board chamber 12 (e.g., via glue, sewing, or otherwise).

In an example, the upper chamber 14 at least partially overhangs the lower chamber 12 at least 5% of the lower chamber length (e.g., by about 8 inches or about 15% of the lower chamber length) to provide extra stability. The upper chamber 14 may also overhang the lower chamber 12 on the side edges and/or the rear portion. In another example, the lower chamber 12 may at least partially overhang the upper chamber 14. In yet another example, the lower chamber 12 and the upper chamber 14 have a substantially equal perimeter and do not overhang one another.

In another example, the chamber 12 and the chamber 14 may be at least partially alongside one another. For example, the upper chamber 14 moves along the top of the lower chamber 12, and then goes outside the lower chamber 12 so that the upper chamber 14 can be level with the lower chamber 12. By way of illustration, the upper chamber 14 may be about three inches thick, and the lower chamber 12 is about six inches thick. This configuration allows the tent to create a rail shape above, below, or both above and below the chamber that is tracing the outside of the rail. The upper chamber 14 may be parallel with the bottom of the lower chamber 12.

In an example, a tent material may overlap between the lower chamber 12 and the upper chamber 14. The tent 16 may be made of PVC or other suitable material. The tent 16 may be connected (e.g., glued, sewed, or otherwise attached) to each chamber 12 and 14 and extend therebetween to cover the overlap between the chambers 12 and 14. The tent 16 forms a shape that is unique to this board, referred to herein as a "hull" shape, as it mimics the hull of a boat or ship. The tent 16 also forms a rail shape that gives the board more stability. The shape also enables the rails of the board to slope outward and away from the center of the board chamber 12.

FIGS. 2A-2F are top and side views illustrating components and assembly of an example inflatable paddle board. FIGS. 3A-4C are top, side, and bottom views, respectively, of the example inflatable paddle board of FIGS. 2A-F shown assembled.

The inflatable paddle board 10 is shown as it may include an inflatable chamber 12 forming a stand-up board. This board chamber 12 may be raised at the front, back, and/or side(s), and may also include one or more fins 18. The inflatable paddle board 10 may also include an inflatable chamber 14 that is substantially U-shaped. This rail board 14 may be connected to the rail chamber 14. The rail chamber 14 may provide sidewalls forming a rail around at least a portion of the board chamber 12. In an example, the rail slopes inward towards a center of the board chamber 12. A tent 16 may cover the area between the board chamber 12 and the rail chamber 14 to form a curve-shaped front hull (see, e.g., FIGS. 2E-2F).

In an example, the rail chamber 14 at least partially overhangs the board chamber 12. For example, the rail chamber 14 may at least partially overhang the front portion of the board chamber 12. In an example, the rail chamber 14 overhangs the board chamber 12 by at least 15% of the length of the board chamber 12.

In an example, the board chamber 12 is wider than the rail chamber 14. In another example, the rail chamber 14 is wider than the board chamber 12. In another example, the board chamber 12 and the rail chamber 14 are the same width, and or the width may vary between the two chambers.

Before continuing, it should be noted that the examples described above are provided for purposes of illustration, and are not intended to be limiting. Other devices and/or device configurations may be utilized to carry out the operations described herein.

Figure 4:
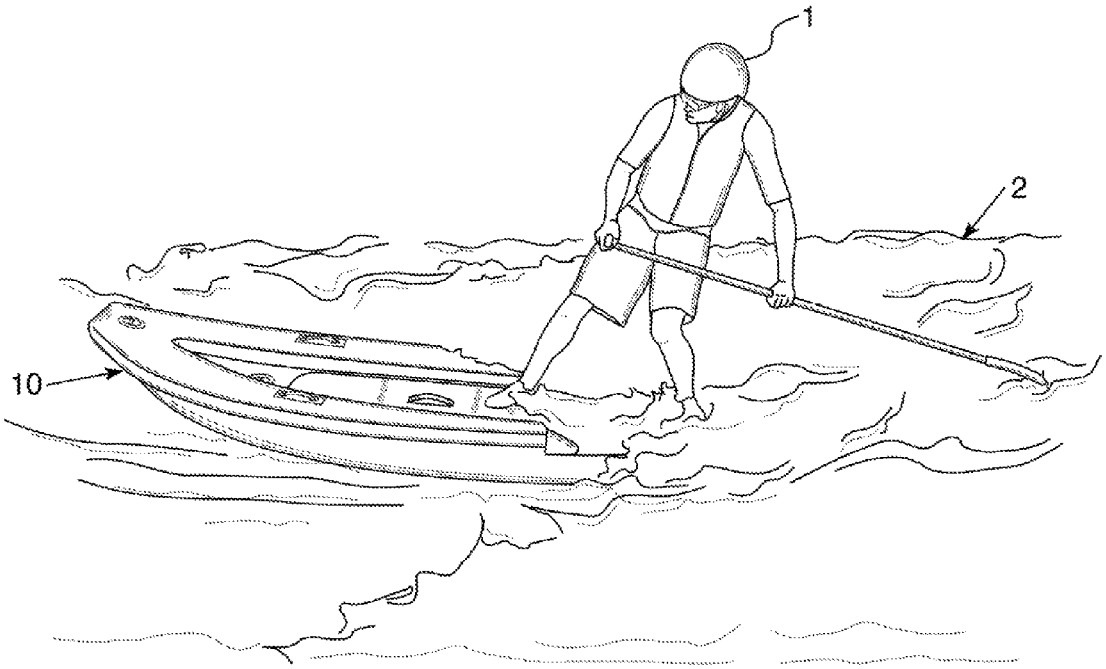
FIGS. 4-6 are illustrations of the inflatable paddle board shown in example use cases.
Figure 5:
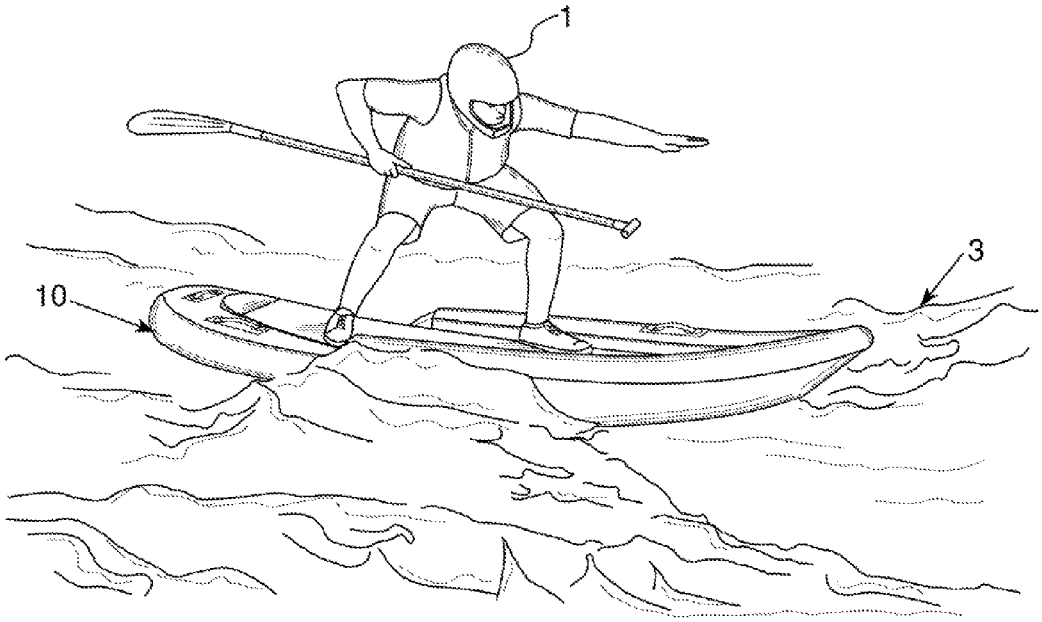
Figure 6:
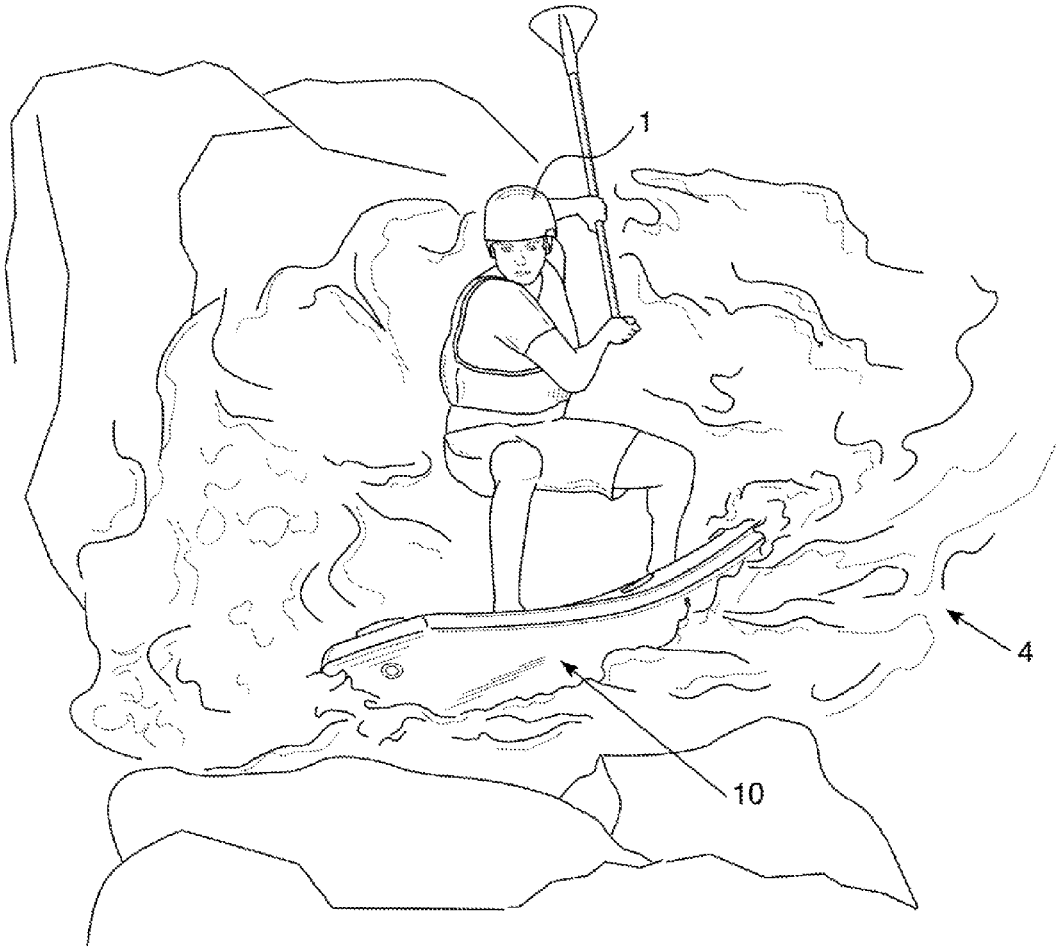

FIGS. 4-6 are illustrations of the inflatable paddle board 10 shown in example use cases. In FIG. 4, a user 1 is shown riding the inflatable paddle board 10 in a standing wave 2. In FIG. 5, a user 1 is shown riding the inflatable paddle board 10 in a whitewater river 3. In FIG. 6, a user 1 is shown riding the inflatable paddle board 10 in larger whitewater 4.

The example inflatable paddle board 10 is shown with a lower inflatable drop stitch chamber (or board chamber) 12, an upper inflatable drop stitch chamber (or rail chamber) 14, and tent 16 connecting the board chamber 12 and the rail chamber 14. The rail chamber 14 is also shown as it may overhang the board chamber 12. The tent 16 is connected with each drop stitch layer so that the tent 16 remains taut when the chambers are inflated.

It is noted that the tent 16 may also be another chamber (e.g., drop stitch chamber), or the tent 16 may be part of the rail chamber 14 and/or board chamber 12 that is folded to connect to the bottom chamber. The tent 16 can be inflatable itself, or be made taut using other construction methods. In another example, the tent 16 can have an inflatable tube or chamber inside, e.g., to aid in pushing the tent structure outward and reduce slack.

The shape of the inflatable paddle board 10 provides a hull structure (e.g., at the front or bow and/or front-side of the board), thus providing extra buoyancy to help the user to navigate the inflatable paddle board 10, and also provides secondary (e.g., side-to-side) stability (e.g., for navigating whitewater).

As can be seen in FIGS. 4-6, the inflatable paddle board 10 is stable on a standing wave and/or on a river and even large whitewater. The inflatable paddle board 10 has a progressive shape throughout its length, enabling a user to paddle large whitewater on the river. The inflatable paddle board 10 also enables a rider to carve the board back and forth while riding on a standing wave.

Figure 7:
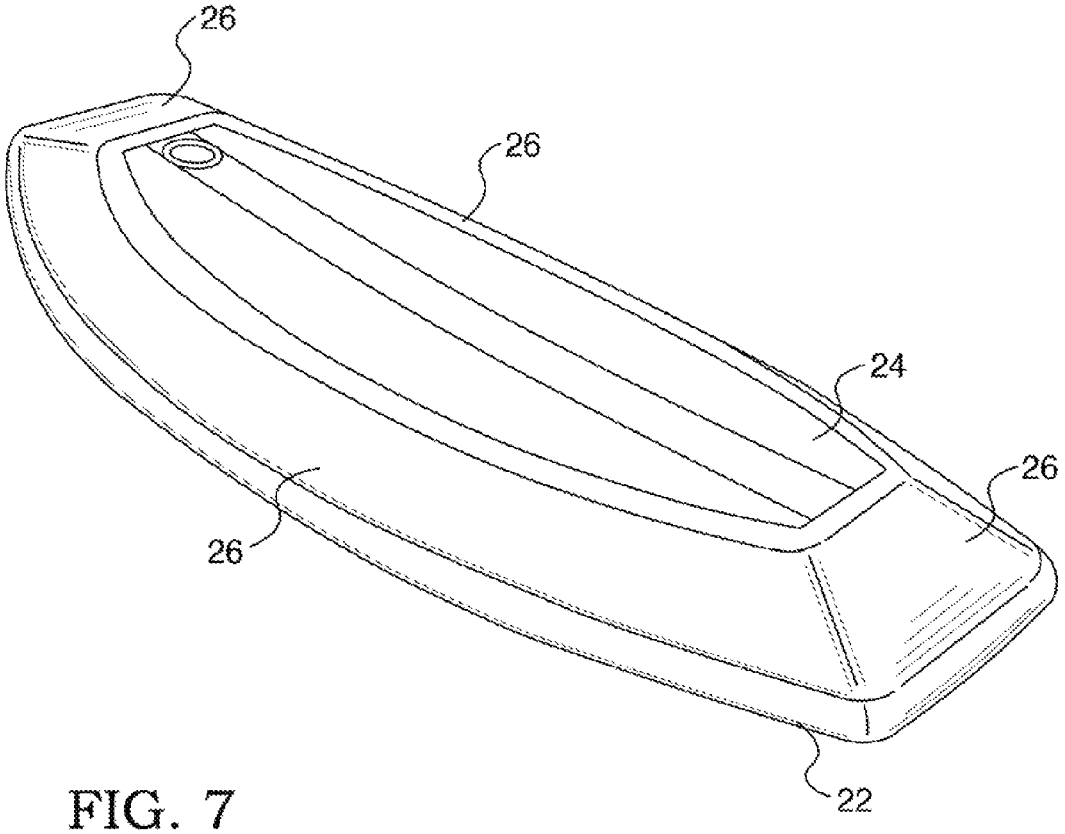
FIG. 7 is a top perspective view of another example inflatable paddle board.
Figure 8A:
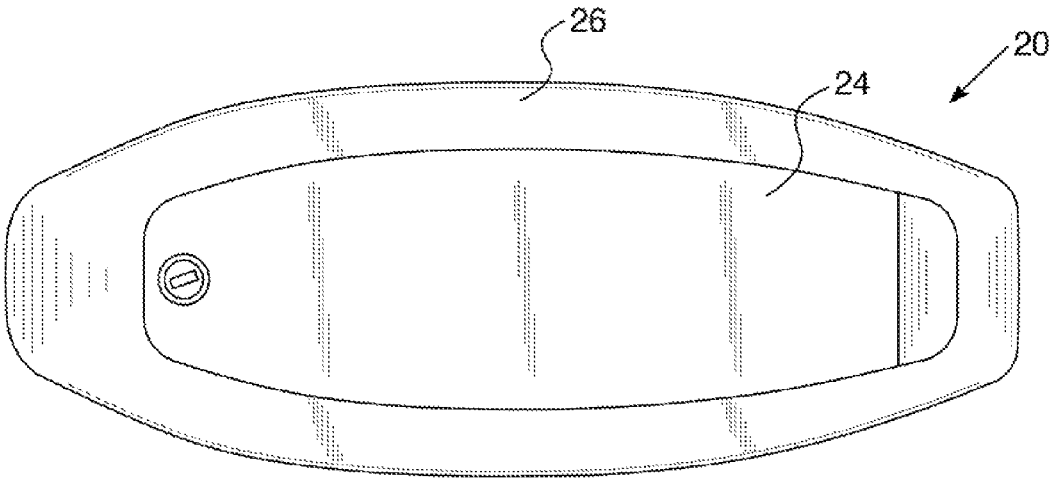
FIGS. 8A-8C are top, side, and bottom views, respectively of the example inflatable paddle board shown in FIG. 7.
Figure 8B:
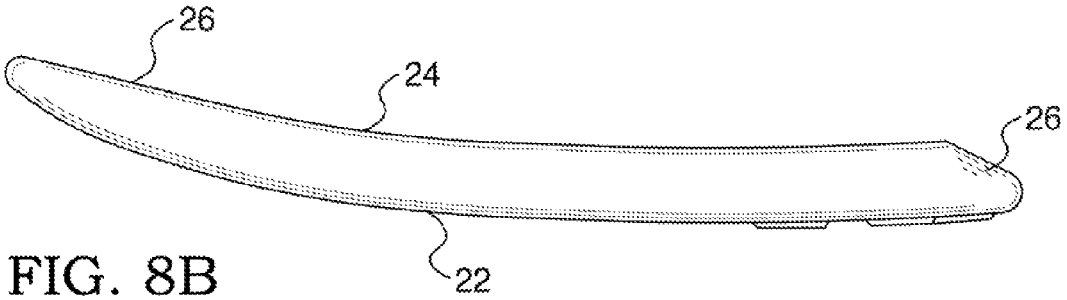
Figure 8C:
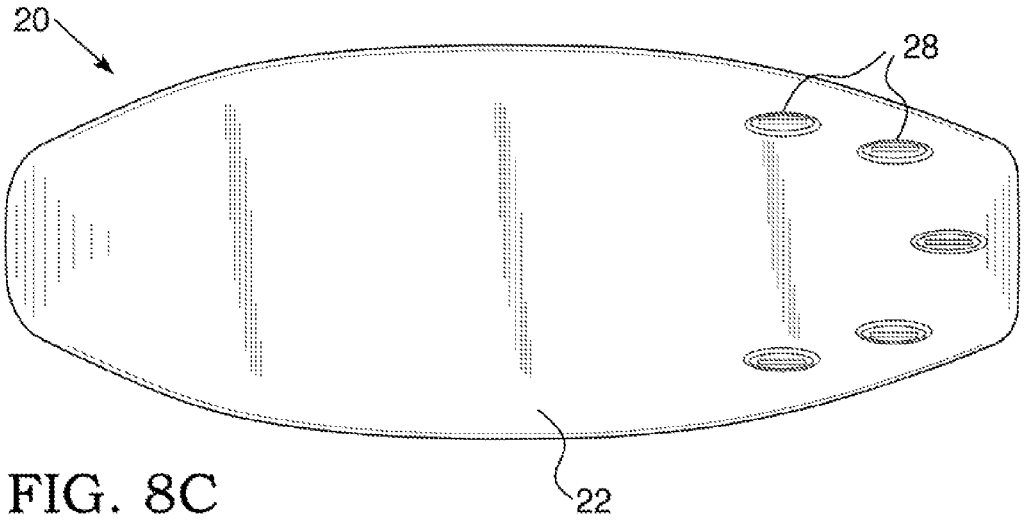

FIG. 7 is a top perspective view of another example inflatable paddle board 20. FIGS. 8A-8C are top, side, and bottom views, respectively of the example inflatable paddle board 20 shown in FIG. 7.

The inflatable paddle board 20 is shown as it may include a lower inflatable chamber 22. This lower chamber 22 may be raised at the front, back, and/or side(s), and may also include one or more fins 28. The inflatable paddle board 20 may also include an upper inflatable chamber 24. This upper chamber 24 may be connected to the lower chamber 22. A tent 26 may cover the area between the upper and lower chamber 22 and 24.

It is noted that the chambers 22 and 24 may be attached to one another by any suitable mechanism (e g., glue, sewing). Likewise, the tent 26 may be attached by any suitable mechanism (e.g., glue, sewing). It is also noted that more than the two chambers 22 and 24 may be provided.

In an example, the lower chamber 22 at least partially overhangs the upper chamber 24. This shape enables the top of the board to slope inward, toward the center of the board, and creates a shape that is better for surfing. In an example, the lower chamber 22 is wider than the upper chamber 24. In another example (not shown), the upper chamber 24 is wider than the lower chamber 22. In another example, the chambers are the same width, and or the width may vary between the two chambers.

It is noted that in any of the above examples, the chambers may be at least partially above and/or below and/or at least partially side-by-side one another. In addition, more than two chambers may be provided. Furthermore, separate chambers may be fluidically interconnected with one another (e.g., at least one air passage therebetween), so that only one fill valve is needed to fill all chambers with air.

It is noted that the examples shown and described are provided for purposes of illustration and are not intended to be limiting. Still other examples are also contemplated.

The invention claimed is:

1. An inflatable paddle board, comprising:

a first inflatable chamber forming a stand-up board; and a second inflatable chamber connected to the first inflatable chamber to form a curve-shaped front hull;

wherein the first inflatable chamber at least partially overhangs the second inflatable chamber, and the first and second inflatable chambers are interconnected with only one fill valve.

2. The inflatable paddle board of claim 1, wherein the second inflatable chamber at least partially overhangs the first inflatable chamber.

3. The inflatable paddle board of claim 2, wherein the second inflatable chamber overhangs a front portion of the first inflatable chamber.

4. The inflatable paddle board of claim 1, wherein the first inflatable chamber overhangs a front portion of the second inflatable chamber.

5. The inflatable paddle board of claim 1, wherein the first inflatable chamber overhangs a rear portion of the second inflatable chamber.

6. The inflatable paddle board of claim 1, wherein the first inflatable chamber overhangs both a front portion and a rear portion of the second inflatable chamber.

7. The inflatable paddle board of claim 1, wherein the second inflatable chamber overhangs the first inflatable chamber for at least 5% of the length of the first inflatable chamber.

8. The inflatable paddle board of claim 1, wherein the second inflatable chamber under-hangs the first inflatable chamber for at least 5% of the length of the first inflatable chamber.

9. The inflatable paddle board of claim 1, wherein the first inflatable chamber is wider than the second inflatable chamber.

10. The inflatable paddle board of claim 1, wherein the second inflatable chamber has sidewalls to form a rail around at least a portion of the first inflatable chamber.

11. The inflatable paddle board of claim 10, wherein the rail slopes inward towards a center of the first inflatable chamber.

12. The inflatable paddle board of claim 1, wherein at least one of the first inflatable chamber and the second inflatable chamber are drop-stitch chambers.

13. The inflatable paddle board of claim 1, further comprising a tent covering between the first inflatable chamber and the second inflatable chamber.

14. The inflatable paddle board of claim 13, wherein the tent forms a separate inflatable air chamber.

15. An inflatable paddle board, comprising:

a lower inflatable chamber forming a stand-up board;

an upper inflatable chamber connected to the lower inflatable chamber, the upper inflatable chamber forming a rail around at least a portion of the lower inflatable chamber, and the combination of the lower and upper inflatable chambers forming a curve-shaped front hull; and a tent covering between the lower inflatable chamber and the upper inflatable chamber.

16. The inflatable paddle board of claim 15, wherein the tent forms a separate inflatable air chamber.

17. The inflatable paddle board of claim 15, wherein the rail is formed around a front and front-side portion of the lower inflatable chamber.

18. A method of constructing an inflatable paddle board, comprising:

forming a stand-up board area from a lower inflatable chamber; and connecting an upper inflatable chamber to the lower inflatable chamber to form a rail around at least a portion of the lower inflatable chamber;

providing a tent covering between the first inflatable chamber and the second inflatable chamber to form a curve-shaped front hull.

19. An inflatable paddle board, comprising:

a first inflatable chamber forming a stand-up board; and a second inflatable chamber connected to the first inflatable chamber to form a curve-shaped front hull;

wherein the second inflatable chamber under-hangs the first inflatable chamber for at least 5% of the length of the first inflatable chamber.

20. An inflatable paddle board, comprising:

a first inflatable chamber forming a stand-up board;

a second inflatable chamber connected to the first inflatable chamber to form a curve-shaped front hull; and a tent covering between the first inflatable chamber and the second inflatable chamber.

* * * * *